US006624561B2

(12) United States Patent
Nakamura et al.

(10) Patent No.: US 6,624,561 B2
(45) Date of Patent: Sep. 23, 2003

(54) COLOR CATHODE RAY TUBE HAVING AN INTERNAL VOLTAGE-DIVIDING RESISTOR

(75) Inventors: Hisao Nakamura, Mobara (JP); Sachio Koizumi, Mobara (JP); Kenji Suzuki, Mobara (JP)

(73) Assignee: Hitachi, Ltd., Tokyo (JP)

( * ) Notice: Subject to any disclaimer, the term of this patent is extended or adjusted under 35 U.S.C. 154(b) by 175 days.

(21) Appl. No.: 09/940,605

(22) Filed: Aug. 29, 2001

(65) Prior Publication Data

US 2002/0053866 A1 May 9, 2002

(30) Foreign Application Priority Data

Sep. 19, 2000 (JP) ..... 2000-282981

(51) Int. Cl.[7] ..... H01J 29/46
(52) U.S. Cl. ..... 313/441
(58) Field of Search ..... 313/441, 447; 315/3, 364, 402; 338/308, 307, 142

(56) References Cited

U.S. PATENT DOCUMENTS 4,760,370 A * 7/1988 Nikaido et al. ..... 338/308
4,786,842 A * 11/1988 Shimoma et al. ..... 315/3
5,914,559 A * 6/1999 Muchi et al. ..... 313/479

FOREIGN PATENT DOCUMENTS

JP 55-38484 3/1980
JP 63006730 A 1/1988
JP 01067846 A 3/1989
JP 02267839 A 11/1990
JP 04255650 A 9/1992
JP 05291010 A 11/1993
JP 06005224 A 1/1994
JP 07134952 A 5/1995

OTHER PUBLICATIONS

U.S. patent application Ser. No. 09/514,285, Tsuruoka et al., filed Feb. 28, 2000.
U.S. patent application Ser. No. 09/516,161, Miyamoto et al., filed Feb. 29, 2000.
U.S. patent application Ser. No. 09/516,202, Nakamura et al., filed Feb. 29, 2000.

* cited by examiner

*Primary Examiner*—Nimeshkumar D. Patel
*Assistant Examiner*—Jason R Phinney
(74) *Attorney, Agent, or Firm*—Antonelli, Terry, Stout & Kraus, LLP

(57) ABSTRACT

A color cathode ray tube has an electron gun in its neck portion. Its focus electrodes and anode are fixed by two insulating support rods. A voltage-dividing resistor is disposed in the vicinity of one of the insulating support rods for producing an intermediate voltage applied to a first one of the focus electrodes adjacent to the anode by dividing an anode voltage. The voltage-dividing resistor includes an insulating film, a resistance pattern, an insulating substrate, and a second film containing an oxide of transition metal, in the order named from the insulating film toward the inner wall of the neck portion. A metal conductor surrounding the voltage-dividing resistor and the one of the insulating support rods is fixed to a second one of the focus electrodes which is disposed upstream of the first one of the focus electrodes in a path of the electron beams.

8 Claims, 8 Drawing Sheets

COLOR CATHODE RAY TUBE HAVING AN INTERNAL VOLTAGE-DIVIDING RESISTOR

BACKGROUND OF THE INVENTION

The present invention relates to a color cathode ray tube, and in particular to a color cathode ray tube provided with an internal voltage-dividing resistor for applying a plurality of different voltages to a plurality of electrodes constituting an electron gun housed in its neck portion, and a conductor for increasing a withstand voltage disposed in a space between the internal voltage-dividing resistor and the inner wall of the neck portion.

A color cathode ray tube used in TV receivers or monitors of information terminals has an electron gun housed within a neck portion of its vacuum envelope for projecting plural electron beams and a phosphor screen (a viewing screen) formed of phosphor elements coated on an inner surface of its panel portion for emitting light of plural colors. A deflection yoke is mounted around the outside of the vacuum envelope for scanning the electron beams from the electron gun on the phosphor screen two-dimensionally to produce a desired image.

In many color cathode ray tubes, a shadow mask serving as a color selection electrode is closely spaced from the phosphor screen such that each of the plural electron beams emitted from the electron gun impinges upon the phosphor elements of its intended color to produce a color image.

For the purpose of improving the quality of a color image over the display screen formed on the phosphor screen, a color cathode ray tube is known which employs an electron gun of the type applying a plurality of high voltages other than its anode voltage to a plurality of electrodes focusing the electron beams.

FIG. 6 is a partially cut-away side view of an essential part of a color cathode ray tube incorporating an electron gun provided with an internal voltage-dividing resistor, and FIG. 7 is a partially cut-away side view of the essential part of the color cathode ray tube of FIG. 6 as viewed in the direction of an arrow A in FIG. 6.

The electron gun for projecting three in-line electron beams is housed within a neck portion 32 of a vacuum envelope 10 of the color cathode ray tube. This electron gun comprises an anode (the sixth grid electrode) supplied with a highest voltage (an anode voltage) 1, an intermediate grid electrode 2 supplied with a voltage obtained by dividing the anode voltage using the internal voltage-dividing resistor, cathodes K for emitting the electron beams, a fifth grid electrode group 3 comprised of plural electrodes constituting a lens for focusing the electron beams emitted from the cathodes K, the fourth grid electrode 4, the third grid electrode 5, the second grid electrode 6, and the first grid electrode 7. The electrodes 1 to 7 are fixed in the specified order with specified respective spacings therebetween by embedding portions of peripheries of the respective electrodes into a pair of insulating support rods 9.

A shield cup 8 is attached to the sixth grid electrode 1, and ends of electrically conductive springs 11 are welded to a sidewall of a front end of the shield cup 8. A portion of the inner wall of the vacuum envelope 10 is coated with an internal conductive film 10*a* made of material such as graphite and extending from the funnel portion toward the neck portion. The other ends of the electrically conductive springs 11 press on the internal conductive film 10*a* such that the anode voltage is supplied to the sixth grid electrode 1 via a high-voltage terminal embedded in the funnel portion.

An internal voltage-dividing resistor 12 of a configuration explained subsequently is attached to an outside surface of one of the insulating support rods 9 facing an inner wall 32*a* of the neck portion. The internal voltage-dividing resistor 12 is provided with terminals 13, 14 and 15 for electrical connection, the terminal 13 is electrically connected to the sixth grid electrode 1 to be supplied with the anode voltage, the terminal 14 is connected to the intermediate grid electrode 2, and the terminal 15 is connected to ground.

The terminal 13 is provided with a connecting tab 13*a* projecting perpendicularly to the longitudinal axis of the electron gun, and the connecting tab 13*a* is connected to the sixth grid electrode 1. A connecting tab 14*a* projects from the terminal 14, and is connected to the intermediate grid electrode 2 to supply thereto a high voltage obtained by dividing the anode voltage by a factor of the ratio of the resistors of the internal voltage-dividing resistor. The terminal 15 is connected to one of stem pins 45 by using an extension of a connecting tab 15*a* or another member such that the terminal 15 is connected to a potential such as ground potential (hereinafter ground potential) outside the cathode ray tube.

A conductor 16 made of a metal wire is disposed to pass through a space between the inner wall 32*a* of the neck portion 32 and the internal voltage-dividing resistor 12 and surround the internal voltage-dividing resistor 12 and one of the insulating support rods 9 mounting the resistor 12, and is welded to one electrode of the fifth grid electrode group 3 on opposite sides of the one of the insulating support rods 9.

The conductor 16 is made of nickel or stainless steel. A portion of metal contained in the conductor 16 is evaporated by heating the conductor 16 using an external high-frequency induction heater after the completed electron gun assembly has been sealed into the neck portion 32 so as to form a metal thin film 16*a* on the inner wall 32*a* of the neck portion, the insulating support rod 9 and the internal voltage-dividing resistor 12 and thereby to produce stable electric potential on the inner wall of the neck portion during operation of the cathode ray tube. Another type of a conductor 16 is also known which uses an extension of a metal wire for connecting together electrodes to be supplied with the same voltage within the cathode ray tube, and still another type of a conductor 16 is also known which has only one of its two ends fixed to the electrode with the other end being not fixed to the electrode.

Reference numeral 17 denotes a conductive film for preventing spark, and the conductive film 17 is a sputtered film of Au—Pd, or Cr, for example, is formed on the surface of the internal voltage-dividing resistor 12 facing the inner wall of the neck portion, and enhances the effects of spot knocking by preventing spark between the conductor 16 and its neighboring electrodes during the spot knocking procedure described subsequently.

FIGS. 8A to 8C are illustrations of the internal voltage-dividing resistor 12 employed in the electron gun of FIG. 7, FIG. 8A is a plan view of the internal voltage-dividing resistor as viewed from its resistance pattern side, and FIGS. 8B and 8C are its side and rear views, respectively.

In the internal voltage-dividing resistor 12, a resistance layer 19 is formed on one surface of an insulating substrate 18 which is preferably made of ceramic by initially printing a resistance material having desired resistance characteristics such as metal oxide including ruthenium oxide in the form of a desired pattern, and then drying and firing the resistance material. Then a first insulating film 20*a* made of glass, glass of a borosilicate lead system, for example, is formed to cover the pattern of the resistance layer 19 (hereinafter the resistance pattern). Similarly a second insulating film 20*b* is formed over the approximately entire area of the rear surface of the insulating substrate 18 except for regions formed with terminals, and further, a spark-preventing conductive film 17 is coated on the specified portion of the second insulating film 20*b*. The spark-preventing conductive film 17 is somewhat displaced toward the high-voltage terminal 13 from the position of the conductor 16. The spark-preventing conductive film 17 is formed by bombarding a target made of Au—Pd or Cr with ions and thereby sputtering Au—Pd or Cr onto the second insulating film 20*b* covered with a stainless steel mask having an opening of the specified shape.

The terminal 13 formed at one end of the internal voltage-dividing resistor 12 is connected to the sixth grid electrode 1 by the connecting tab 13*a* projecting from the terminal 13, the terminal 15 formed at the other end of the internal voltage-dividing resistor 12 is connected to an electrode piece at ground potential by the connecting tab 15*a* projecting from the terminal 15, and the terminal 14 formed at the intermediate position of the internal voltage-dividing resistor 12 is connected to the intermediate electrode 2 by the connecting tab 14*a* projecting from the terminal 14.

Conductive films (connection leads) 13*b*, 14*b* and 15*b* are provided at and connected to the positions of the resistance layer 19 corresponding to the connecting tabs 13*a*, 14*a* and 15*a*, respectively, and the connecting tabs 13*a*, 14*a* and 15*a* are clamped to the conductive films 13*b*, 14*b* and 15*b*, respectively, as by eyelet-riveting. The conductive films (the connection leads) 13*b*, 14*b* and 15*b* are not covered by the insulating film 20*a* which covers the resistance layer 19, and therefore they are exposed.

FIG. 9 is a partially cut-away front view of a neck portion of another example of a conventional color cathode ray tube. The color cathode ray tube shown in FIG. 9 differs in configuration from those explained in connection with FIGS. 6 and 7, in that its internal voltage-dividing resistor 92 is disposed at a position rotated through 90 degrees about the axis of the cathode ray tube from the positions of insulating support rods 93 and its electron gun is not provided with a conductor surrounding the internal voltage-dividing resistor 92 and the insulating support rod 93 corresponding to the above-described conductor 16. However, the surface of an insulating substrate 92A facing an electron gun 94 is covered with a film 92B made of an oxide of transition metal, and the other surface of the insulating substrate 92A facing the neck tube 95 is covered with an insulating film 92D (an insulating protective film) made of glass of a borosilicate lead system which covers a resistance pattern 92C.

Color cathode ray tubes incorporating internal voltage-dividing resistors of this kind are disclosed in Japanese Utility Model Application Laid-open No. Sho 55-38484 (laid-open on Mar. 12, 1980), Japanese Patent Application Laid-open Hei 6-5224 (laid-open on Jan. 14, 1994), Japanese Patent No. 2,638,835 (corresponding to Japanese Patent Application Laid-open No. Hei 1-67846 laid-open on Mar. 14, 1989), Japanese Patent No. 1,952,176 (corresponding to Japanese Patent Application Laid-open No. Sho 63-6730 laid-open on Jan. 12, 1988), for example.

SUMMARY OF THE INVENTION

It is one of the present invention to provide a color cathode ray tube employing an electron gun provided with a low-cost internal voltage-dividing resistor with superior withstand voltage characteristics and capable of providing a high-definition image display.

To achieve the above objects, in accordance with an embodiment of the present invention, there is provided a color cathode ray tube comprising: a vacuum envelope comprising a panel portion having a phosphor screen formed on an inner surface thereof, a neck portion, and a funnel portion connecting the panel portion and the neck portion; an electron gun housed in the neck portion comprising an electron beam generating section, a plurality of focus electrodes and an anode arranged in the order named for focusing three electron beams emitted from the electron beam generating section onto the phosphor screen, the electron beam generating section, the plurality of focus electrodes and the anode being fixed in predetermined axially spaced relationship by a pair of insulating support rods; a voltage-dividing resistor for producing an intermediate voltage to be applied to a first one of the plurality of focus electrodes adjacent to the anode by dividing a voltage applied to the anode, the voltage-dividing resistor being disposed in the vicinity of a surface of one of the pair of insulating support rods on a side thereof facing toward an inner wall of the neck portion, the voltage-dividing resistor comprising an insulating film, a resistance pattern, an insulating substrate, and a second film containing an oxide of transition metal in the order named from the insulating film toward the inner wall of the neck portion; and a metal conductor surrounding the voltage-dividing resistor and the one of the pair of insulating support rods and fixed to a second one of the plurality of focus electrodes, the second one of the plurality of focus electrodes being disposed upstream of the first one of the plurality of focus electrodes in a path of the three electron beams.

This configuration of the present invention provides a color cathode ray tube employing an electron gun provided with a low-cost internal voltage-dividing resistor having superior withstand voltage characteristics.

The present invention is not limited to the above configurations, and various changes and modifications may be made without departing from the scope of the invention as defined in the appended claims.

BRIEF DESCRIPTION OF THE DRAWINGS

In the accompanying drawings, in which like reference numerals designate similar components throughout the figures, and in which.

DETAILED DESCRIPTION

In the manufacture of a color cathode ray tube, after the cathode ray tube has been exhausted of gases and sealed, it is subjected to the so-called spot-knocking (high-voltage stabilization) treatment. The color cathode ray tube is normally operated at an anode voltage of 25 to 30 kV. The spot-knocking (high-voltage stabilization) is carried out by applying a high voltage of about twice the normal anode voltage to the anode, and thereby forcing spark between the electrodes of the electron gun assembly and between the electrodes and the inner wall of the neck portion and consequently, removing projections in the electrodes or foreign particles within the cathode ray tube such that spark is prevented from occurring within the color cathode ray tube during the normal operation of the completed color cathode ray tube.

Figure 10:
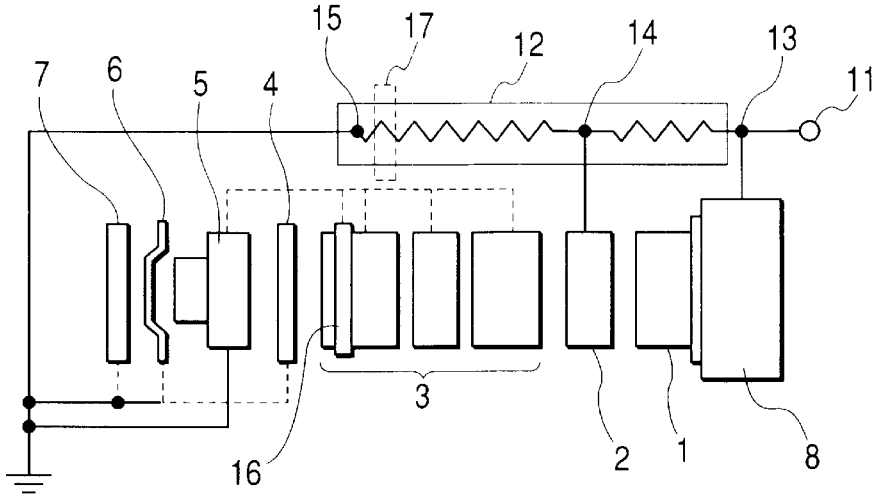
FIG. 10 is an electrical circuit diagram for explaining the electrical connection for the spot-knocking procedure.

FIG. 10 shows an example of an electrical configuration for spot-knocking the color cathode ray tube. The electrodes upstream of the fifth grid electrode group 3 in the electron beam path are connected together and grounded as indicated by broken lines, the sixth grid electrode 1 serving as the anode is supplied with twice the normal anode voltage, and the intermediate grid electrode 2 is supplied with a high spot-knocking voltage obtained by dividing the high voltage applied to the anode using the internal voltage-dividing resistor 12. In the spot-knocking procedure, the above-described conductor 16 is grounded, is disposed to surround the internal voltage-dividing resistor 12 stacked on the insulating support rod 9, and therefore is brought close to the inner wall of the neck portion, and consequently, strong spark is generated between the anode 1 and the conductor 16.

The internal voltage-dividing resistor 12 is arranged such that its front surface having the resistance pattern 19 and an first insulating film 20*a* thereon faces the insulating support rod 9 and its rear surface having a second insulating film 20*b* thereon faces the inner wall 32*a* of the neck portion.

Generally, a surface of glass is apt to emit secondary electrons, and therefore electron avalanches easily occur. Consequently, if a high voltage is applied across two opposing glass surfaces, the electron avalanches occur and easily generate spark.

In the spot-knocking procedure intended for generating spark between the electrodes and thereby cleaning the inside of the color cathode ray tube including the surfaces of the electrodes, the expected results are not sometimes achieved because sparks are generated only between the sixth grid electrode 1 supplied with a high voltage of about 60 kV and the terminal 15 of the internal voltage-dividing resistor 12 or between the sixth grid electrode 1 and the conductor 16 due to synergism of the cause of the electron avalanches occurring between the insulating glass film 20*b* covering the rear surface of the internal voltage-dividing resistor 12 and the inner glass wall 32*a* of the neck portion and the location of the conductor 16, and therefore the spot-knocking is not produced between the intended electrodes.

As a means for solving this problem, a configuration is proposed which deposits the spark-preventing conductive film 17 on the insulating glass film 20*b* covering the rear surface of the internal voltage-dividing resistor 12 facing toward the inner wall 32*a* of the neck portion at a position somewhat displaced toward the high-voltage terminal 13 from that of the conductor 16.

Further, another means is proposed which disperses oxide of transition metal such as Fe, Ni or Cr in the first insulating film 20*a* covering the resistance pattern of the internal voltage-dividing resistor 12 and arranges the first insulating film 20*a* to face the inner wall 32*a* of the neck portion, and thereby suppresses secondary electron emission.

However, in the first means which forms the spark-preventing conductive film 17 on the insulating glass film 20*b* covering the rear surface of the internal voltage-dividing resistor 12 facing the inner wall 32*a* of the neck portion, initially the internal voltage-dividing resistor 12 is completed without spark-preventing conductive film 17, and then in an additional process step, the spark-preventing conductive film 17 is formed on the internal voltage-dividing resistor 12. In handling the internal voltage-dividing resistor 12 in the additional process step, chipping of its ends or films and its contamination occur, and further, there is possibility of change in its characteristics in the operation of removing the contamination, and hence there is possibility that the characteristics essential for the internal voltage-dividing resistor are lost, and consequently, it is inevitable that yield rate of the internal voltage-dividing resistors decreases. Furthermore, the fabrication of the spark-preventing conductive film 17 needs expensive high-precision evaporation equipment and highly-controlled evaporating operation, and this and the decrease in the yield rate inevitably increase the cost of the internal voltage-dividing resistor.

On the other hand, in the second means which disperses oxide of transition metal such as Fe, Ni or Cr in the first insulating film 20*a* covering the resistance pattern of the internal voltage-dividing resistor 12 and arranges the first insulating film 20*a* to face the inner wall 32*a* of the neck portion, no additional process step is needed, unlike in the first means. However, Na (sodium), which has been originally contained in the insulating film 20*a* as impurities, moves toward the negative potential side due to electrical conductivity imparted to the insulating film 20*a* itself, reduces lead oxide which constitutes the insulating film 20*a* to metallic lead, resulting in reinforcement of unwanted conductivity, accelerates generation of migration, and consequently, decreases withstand voltages between portions of the resistance pattern. This phenomenon varies the resistance values of the internal voltage-dividing resistor, therefore varies the high voltage on the intermediate grid electrode 2 which is produced by dividing the anode voltage by a factor of the resistance ratio, resulting in degradation of focus characteristics, and consequently, it is difficult to obtain a sharp image display.

Now, the embodiments in accordance with the present invention will be explained in detail by reference to the drawings.

Figure 1A:
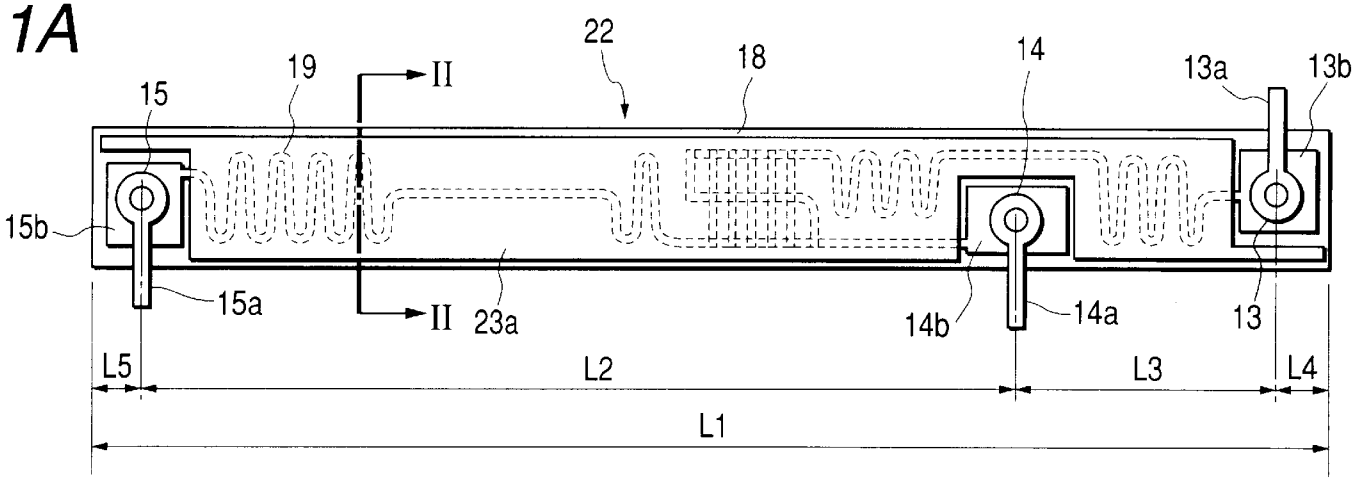
FIGS. 1A and 1B are illustrations of an internal voltage-dividing resistor employed in an electron gun of the color cathode ray tube in accordance with an embodiment of the present invention, FIG. 1A being a plan view of the internal voltage-dividing resistor, and FIG. 1B being a rear view of the internal voltage-dividing resistor of FIG. 1A.
Figure 1B:
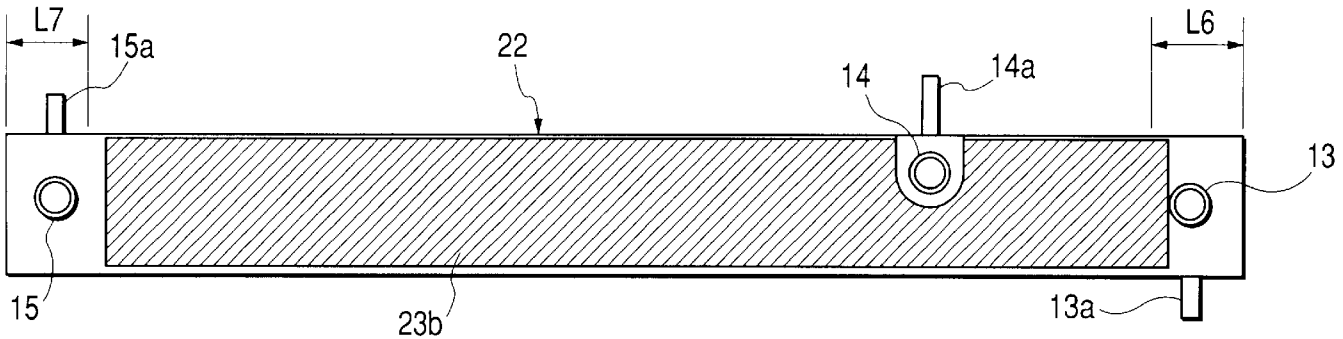
Figure 2:
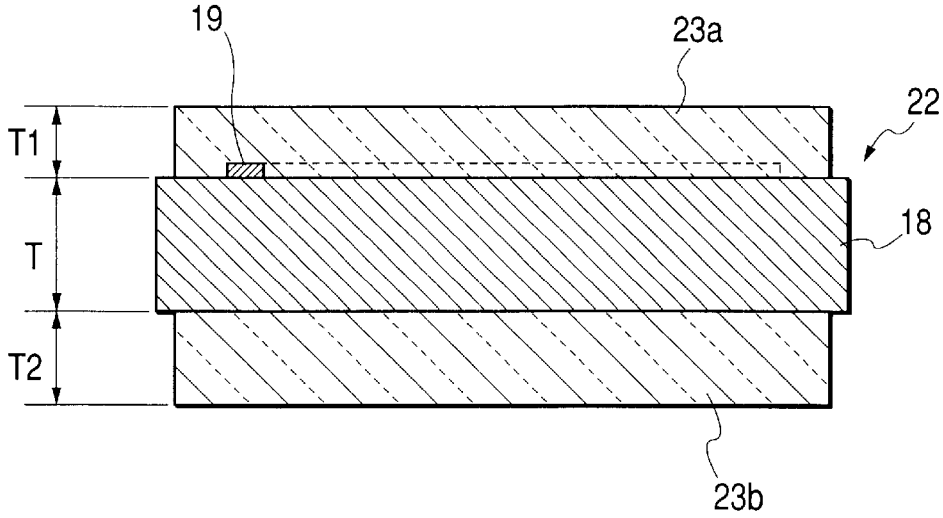
FIG. 2 is a schematic cross-sectional view of an essential part of the internal voltage-dividing resistor of FIG. 1A taken along line II—II of FIG. 1A.

FIGS. 1A and 1B are illustrations of an internal voltage-dividing resistor employed in an electron gun of the color cathode ray tube in accordance with an embodiment of the present invention, FIG. 1A is a plan view of the internal voltage-dividing resistor, and FIG. 1B is a rear view of the internal voltage-dividing resistor of FIG. 1A. FIG. 2 is a schematic cross-sectional view of an essential part of the internal voltage-dividing resistor of FIG. 1A taken along line II—II of FIG. 1A. The same reference numerals as utilized in FIG. 7 designate corresponding portions in FIGS. 1A, 1B and 2.

Figure 7:
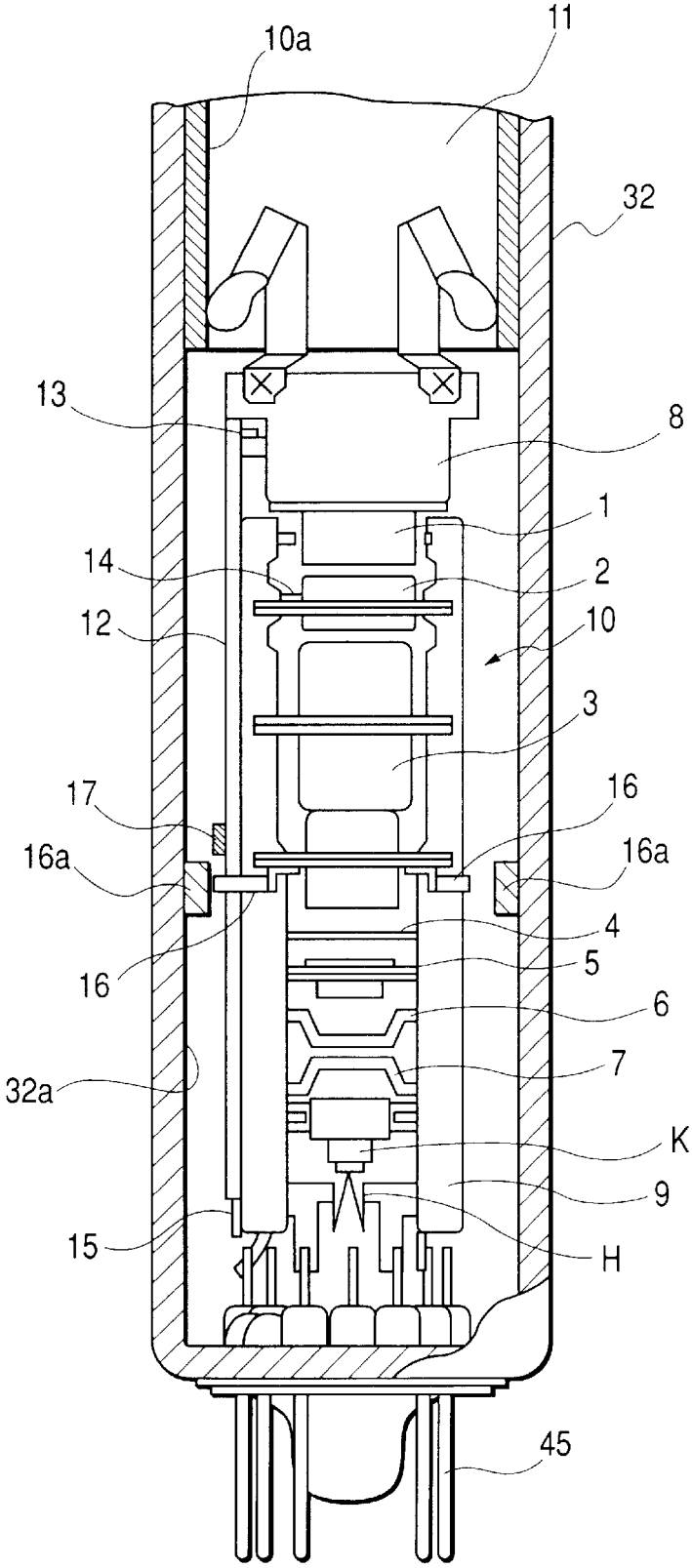
FIG. 7 is a partially cut-away side view of the essential part of the color cathode ray tube of FIG. 6 as viewed in the direction of an arrow A in FIG. 6.
Figure 8A:
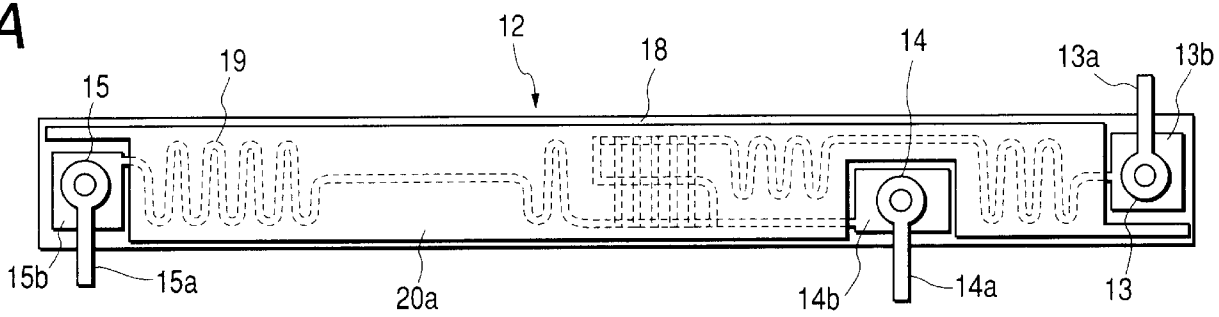
FIGS. 8A to 8C are illustrations of an internal voltage-dividing resistor employed in an electron gun, FIG. 8A being a plan view of the internal voltage-dividing resistor, FIG. 8B being a side view thereof, and FIG. 8C being a rear view thereof.
Figure 8B:
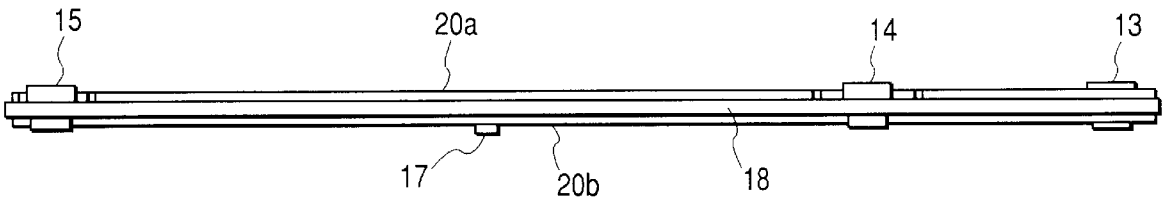
Figure 8C:
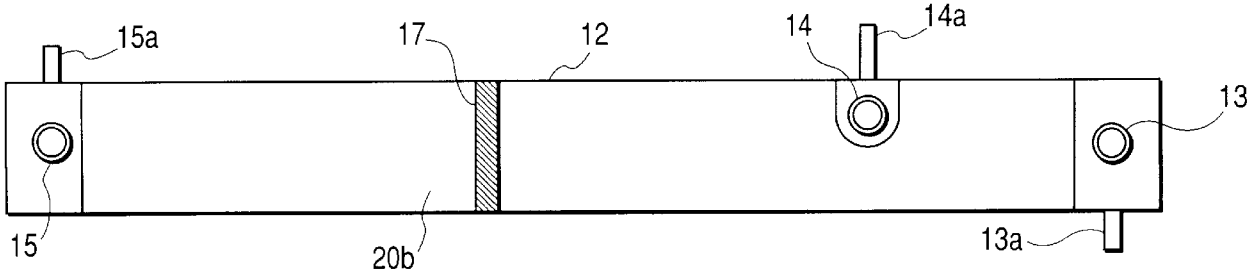
Figure 9:
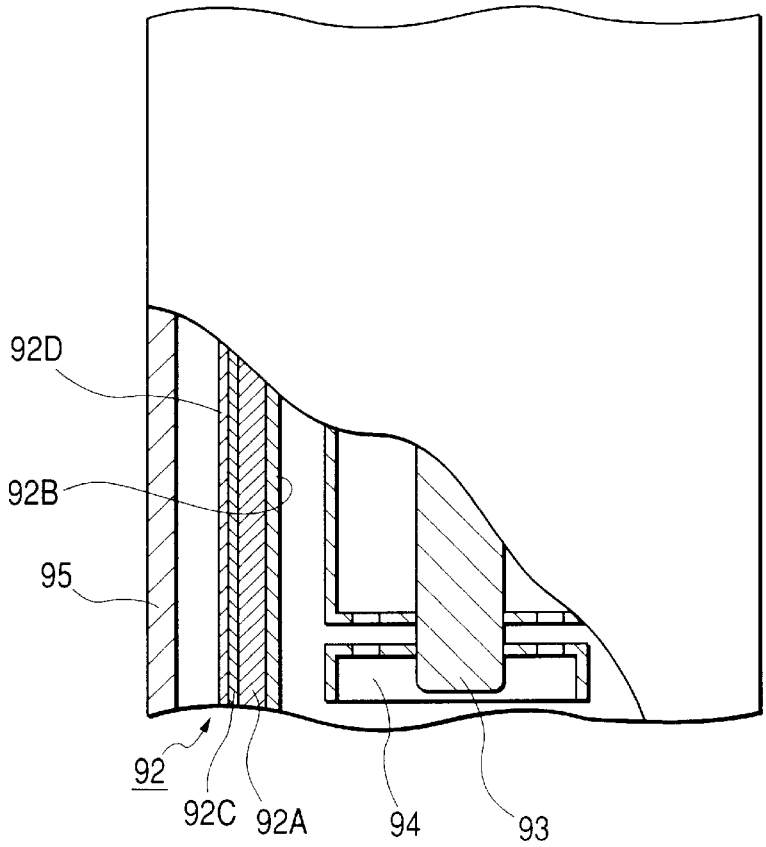
FIG. 9 PRIOR ART
FIG. 9 is a partially cut-away side view of a conventional color cathode ray tube.

In an internal voltage-dividing resistor 22, before it is attached to the electron gun, shown in FIGS. 1A, 1B and 2, a resistance layer (a resistance pattern) 19 in the form of a specified pattern) is formed on an insulating substrate 18, as by screen printing, as in the case of the conventional internal voltage-dividing resistor explained in connection with FIG. 7, and terminals projecting from the internal voltage-dividing resistor 22 are clamped to the internal voltage-dividing resistor 22, as by eyelet-revetting, the terminals including a terminal 13 to be connected to the high-voltage electrode, a terminal 14 to be connected to the intermediate electrode, and a terminal 15 to be connected to ground.

An insulating film 23*a* having a composition described subsequently is formed to a thickness T1 so as to cover the resistance layer 19, and the internal voltage-dividing resistor 22 is incorporated into the color cathode ray tube such that the insulating film 23*a* faces one of the insulating support rods of the electron gun. On the other hand, another film 23*b* having a composition described subsequently is formed to a thickness T2 on the rear surface of the insulating substrate 18, and the film 23*b* is disposed to face the inner wall 32*a* of the neck portion.

The insulating film 23*a* disposed to face the insulating support rod 9 comprises glass of a borosilicate lead system containing at least 20 weight percent of lead oxide (PbO).

On the other hand, the film 23*b* disposed to face the inner wall 32*a* of the neck portion includes oxide of at least one transition metal selected among a group consisting Zn, Cd, Fe, Mn, Cu, Ni, Cr, Co and Zr in addition to the glass of the borosilicate lead system constituting the insulating film 23*a*.

The remaining components in this embodiment are similar to corresponding ones of the conventional color cathode ray tube already explained, and repetition of their explanations is omitted.

The following explains an example of a method of fabricating the internal voltage-dividing resistor 22.

Initially, an insulating substrate 18 is prepared which is made of material of alumina containing at least 96 weight percent of Al, and has a thickness T of 0.635 mm, a width of 5 mm, and a length L1 of 58 mm. Then a resistance pattern made principally of ruthenium oxide and intended for the resistance pattern 19 is screen-printed on a surface of the insulating substrate 18 which has been formed with the terminals 13 to 15 in advance by using material approximately similar to that of the resistance pattern. Then, after drying, the resistance pattern is fired at 850° C. to form the resistance pattern 19.

Next, a paste of glass of the borosilicate lead glass system having a Composition Example 1 shown below is coated except for portions of the ends of the resistance pattern 19 so as to cover the resistance pattern 19 to such a coating thickness that the thickness of the glass film becomes 0.15 mm after being fired.

Composition Example 1 of Glass of the Borosilicate Lead Glass System

| | |
|---|---|
| lead oxide | 55 weight percent |
| silicon oxide | 29 |
| boron oxide | 8 |
| aluminum oxide | 4 |
| others | the balance |

A paste of glass of the borosilicate lead glass system mixed with iron oxide and having a Composition Example 2 shown below is coated on the rear surface of the insulating substrate 18 except for portions of its ends to such a coating thickness that the thickness of the glass film becomes 0.25 mm after being fired.

Composition Example 2 of Glass of the Borosilicate Lead Glass System

| | |
|---|---|
| lead oxide | 55 weight percent |
| silicon oxide | 27 |
| boron oxide | 10 |
| aluminum oxide | 5 |
| iron oxide | 3 |

After drying, the glass films are fired at 600° C. for 40 minutes, the insulating film 23*a* having a thickness T1 of 0.15 mm and the film 23*b* having a thickness T2 of 0.25 mm are obtained to provide the internal voltage-dividing resistor 22.

Surfaces of the insulating film 23*a* and the film 23*b* of the finished internal voltage-dividing resistor 22 are practically white and black, respectively, and difference in color between the two surfaces facilitates discrimination between the insulating film 23*a* and the film 23*b* of the finished internal voltage-dividing resistor 22.

The dimensions in FIGS. 1A and 1B are as follows:

| | | | |
|---|---|---|---|
| L1 | 58 mm | L2 | 40 mm |
| L3 | 14 | L4 | 2 |
| L5 | 2 | L6 | 3.5 |
| L7 | 3.5 | | |

In the usual internal voltage-dividing resistor, its overall length L1 is in a range from 50 mm to 100 mm, its width is in a range from 5 mm to 10 mm, and its overall thickness including the two films on the two surfaces and the terminals is in a range from about 1 mm to about 2 mm.

In the internal voltage-dividing resistor fabricated as described above, the insulating film 23*a* covering the resistance pattern 19 is formed of the glass of the borosilicate lead glass only, and therefore occurrence of migration is suppressed such that insulating characteristics between portions of the resistance pattern and between the resistance pattern and the terminals are sufficiently ensured, and consequently, various problems were solved which have been caused by precipitation of metallic lead.

Utilization of the borosilicate lead system glass containing at least 20 weight percent of lead oxide prevents warping or bending of the internal voltage-dividing resistor, makes possible firing of the insulating film at a temperature lower than a firing temperature of about 850° C. required for glass of other systems used for the same purpose, and consequently, there is no possibility that the resistance pattern is damaged by firing required for fabrication of the insulating film.

By including the oxide of transition metal such as iron oxide or cobalt oxide in the borosilicate lead system glass of the film 23*b* on the rear surface of the internal voltage-dividing resistor, secondary electron emission is suppressed, and the film 23*b* is in a state similar to floating electrically during the spot-knocking procedure. As a result, a desired sparking path is secured without providing the spark-preventing conductive film 17 for that purpose, and sufficiently intense sparks can be generated between the electrodes, and therefore, satisfactory spot-knocking effects can be obtained. Consequently, various problems associated with fabrication of the spark-preventing conductive film 17 have been solved, resulting in reduction of the cost of the internal voltage-dividing resistor.

Moreover, when the thickness of the film 23*b* is selected to be larger than that of the insulating film 23*a* formed on the front surface of the internal voltage-dividing resistor 22, in addition to prevention of the warping or bending of the internal voltage-dividing resistor, the withstand voltage characteristics are capable of being improved further.

Figure 3:
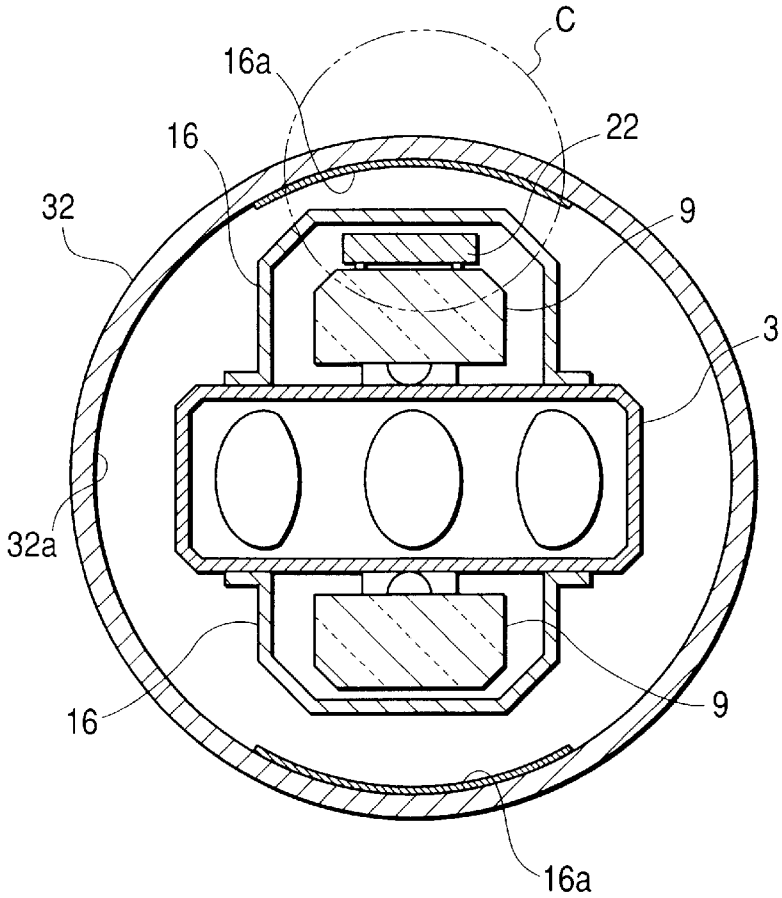
FIG. 3 is a cross-sectional view of a neck portion of a color cathode ray tube in accordance with another embodiment of the present invention taken along a plane perpendicular to its tube axis.
Figure 4:
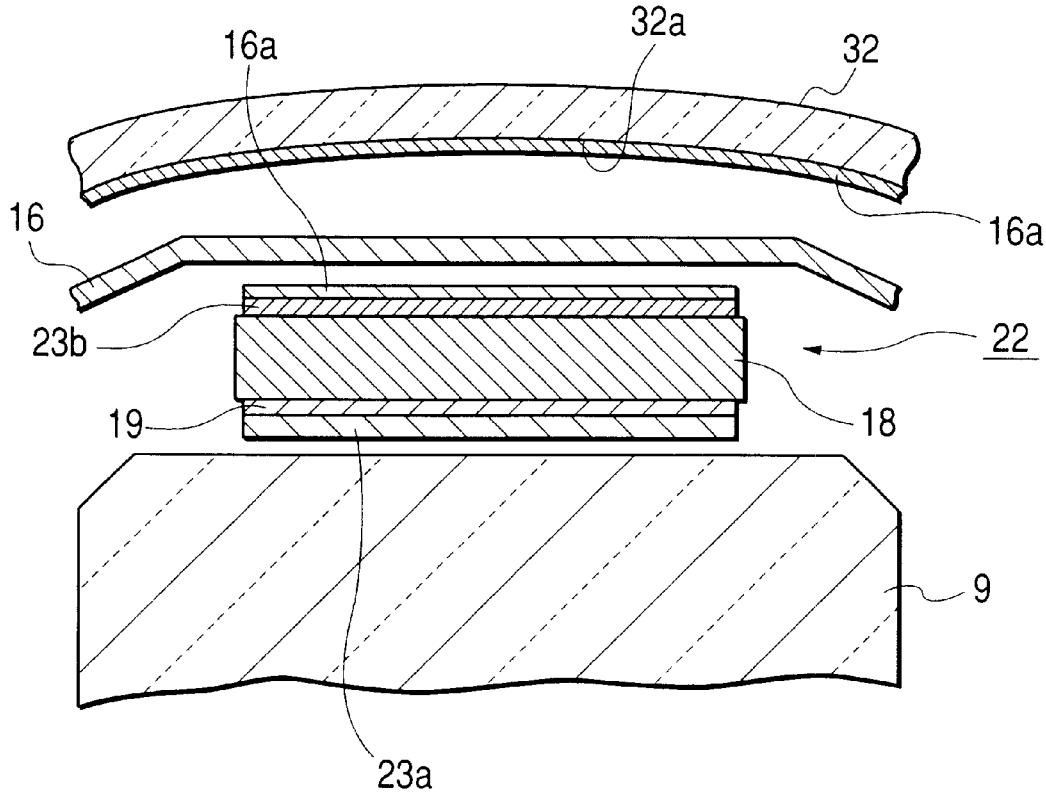
FIG. 4 is an enlarged cross-sectional view of a portion of the neck portion indicated by "C" of FIG. 3.

FIG. 3 is a cross-sectional view of a neck portion of a color cathode ray tube in accordance with another embodiment of the present invention taken along a plane perpendicular to its tube axis, and FIG. 4 is an enlarged cross-sectional view of a portion of the neck portion indicated by "C" of FIG. 3. The same reference numerals as utilized in FIGS. 1A, 1B, 2, and 6–10 designate corresponding portions in FIGS. 3 and 4.

In FIGS. 3 and 4, the internal voltage-dividing resistor 22 is disposed outside of one of a pair of insulating support rods 9, that is, on the side of the one of the insulating support rods facing the inner wall 32*a* of the neck portion 32, and the conductor 16 is disposed to surround the internal voltage-dividing resistor 22 and the insulating support rod 9 mounting the resistor 22 in a space between the inner wall 32*a* of the neck portion and the internal voltage-dividing resistor 22 and is welded at its two ends to the fifth grid electrode 3.

Similarly, another conductor 16 is disposed to surround the other one of the two insulating support rods 9 not mounting the internal voltage-dividing resistor 22. Reference numeral 16*a* denote metal films which are evaporated films formed by heating the conductors 16. The evaporated films are deposited on the inner wall 32*a*, the internal voltage-dividing resistor 22, the insulating support rods 9 and others (the evaporated films on the support rods 9 are not shown in FIG. 3 or 4).

The internal voltage-dividing resistor 22 is arranged such that the resistance pattern 19 and the insulating film 23*a* covering it face one of the insulating support rods 9, and the film 23*b* formed of the borosilicate lead system glass and oxide of transition metal dispersed in the glass on its rear surface faces the inner wall 32*a* of the neck portion.

Figure 5:
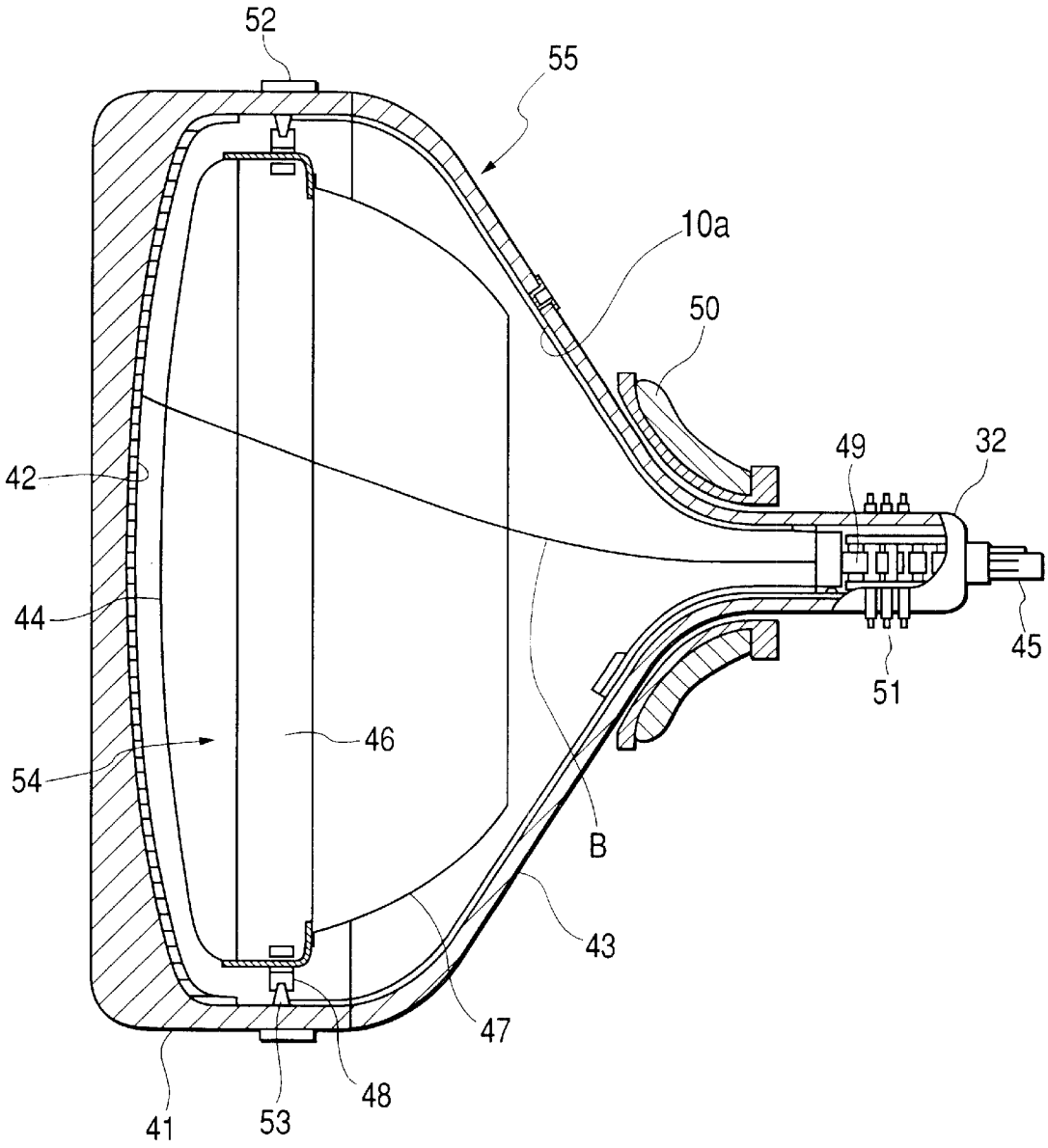
FIG. 5 is a schematic cross-sectional view of a color cathode ray tube in accordance with another embodiment of the present invention for explaining its exemplary overall configuration.
Figure 6:
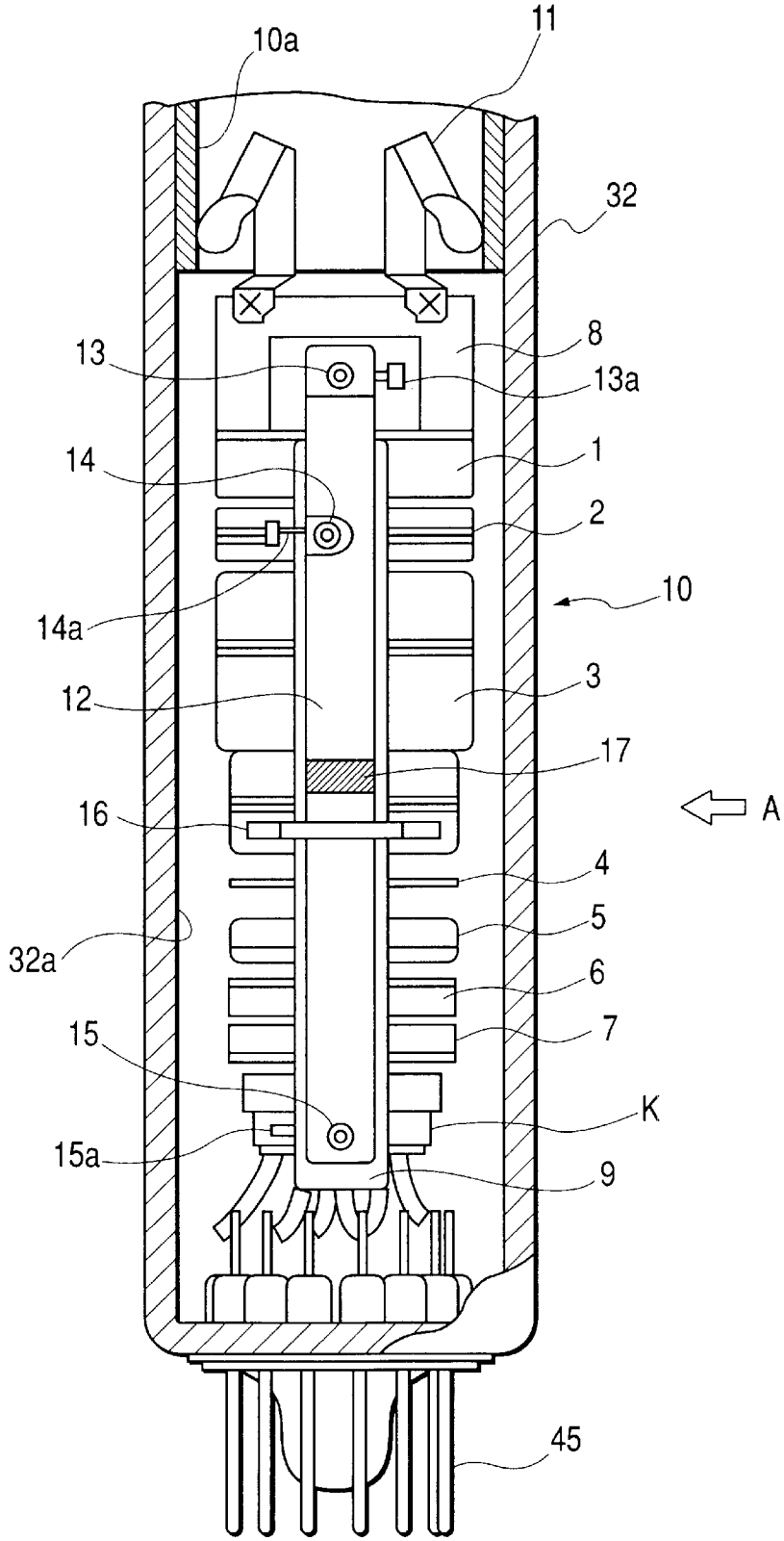
FIG. 6 is a partially cut-away side view of an essential part of a color cathode ray tube incorporating an electron gun provided with an internal voltage-dividing resistor.

FIG. 5 is a schematic cross-sectional view of a color cathode ray tube in accordance with another embodiment of the present invention for explaining its exemplary overall configuration. Reference numeral 41 denotes a panel portion, 42 is a phosphor screen, 32 is a neck portion housing the electron gun, 43 is a funnel portion connecting the panel portion 41 and the neck portion 32, 44 is a shadow mask, 46 is a mask frame, 47 is a magnetic shield, 48 is a mask suspension mechanism, 49 is an in-line type electron gun, 50 is a deflection yoke, 51 is an external magnetic correction device, 10*a* is an internal conductive coating, 52 is an implosion proofing band, 53 are panel pins, 54 is a shadow mask assembly, and 45 are stem pins.

In this color cathode ray tube, a vacuum envelope 55 is formed of the panel portion 41, the neck portion 32 and the funnel portion 43, and three electron beams B (one center beam and two side beams) are emitted from the electron gun 49 housed within the neck portion 32, and scan the phosphor screen 42 two-dimensionally by being subjected to horizontal and vertical deflection magnetic fields generated by the deflection yoke 50.

The three electron beams are intensity-modulated by signals such as video signals supplied via stem pins 45, then are subjected to color selection by the shadow mask 44 disposed immediately in front of the phosphor screen 42, and then impinge upon respective phosphor elements of red, green and blue constituting the phosphor screen 42 so as to reproduce an intended color image. The in-line type electron gun 49 employs the internal voltage-dividing resistor of the configuration explained in connection with the preceding embodiments.

The present invention is not limited to the above configurations, and various changes and modifications may be made without departing from the scope of the invention. The present invention is not limited to a color cathode ray tube provided with an electron gun for emitting a plurality of electron beams, and is equally applicable to various types of cathode ray tubes employing an electron gun provided with an internal voltage-dividing resistor, including a single-electron-beam type cathode ray tube such as a projection type cathode ray tube.

As explained above, in the present invention, the internal voltage-dividing resistor is disposed in the vicinity of an outside surface of one of two insulating support rods fixing plural electrodes in specified axially spaced relationship in the specified order by embedding therein peripheries of the respective electrodes, the internal voltage-dividing resistor is provided on its one surface facing the inner wall of the neck portion with the film formed of the borosilicate lead system glass and oxide of transition metal dispersed in the glass, is also provided on its other surface facing the one of the insulating support rods with the insulating film formed of the borosilicate lead system glass, and the conductor is disposed to surround both the one of the insulating support rods and the internal voltage-dividing resistor, and is fixed at its two ends to one of the plural electrodes. With this configuration of the present invention, sufficient spot-knocking effects are obtained without providing the film with the spark-preventing conductive film incurring an increase in cost, secondary electron emission between the internal voltage-dividing resistor and the inner wall of the neck portion is suppressed such that the good withstand voltage characteristics are retained and thereby variations in resistance values are prevented. Consequently, the present invention provides a color cathode ray tube employing the electron gun provided with a low-cost internal voltage-dividing resistor having superior withstand voltage characteristics without deteriorating focus characteristics and capable of providing a high-definition image display.

What is claimed is:

1. A color cathode ray tube comprising:

a vacuum envelope comprising a panel portion having a phosphor screen formed on an inner surface thereof, a neck portion, and a funnel portion connecting said panel portion and said neck portion;

an electron gun housed in said neck portion comprising an electron beam generating section, a plurality of focus electrodes and an anode arranged in the order named for focusing three electron beams emitted from said electron beam generating section onto said phosphor screen, said electron beam generating section, said plurality of focus electrodes and said anode being fixed in predetermined axially spaced relationship by a pair of insulating support rods;

a voltage-dividing resistor for producing an intermediate voltage to be applied to a first one of said plurality of focus electrodes adjacent to said anode by dividing a voltage applied to said anode, said voltage-dividing resistor being disposed in the vicinity of a surface of one of said pair of insulating support rods on a side thereof facing toward an inner wall of said neck portion, said voltage-dividing resistor comprising an insulating film, a resistance pattern, an insulating substrate, and a second film containing an oxide of transition metal in the order named from said insulating film toward said inner wall of said neck portion; and a metal conductor surrounding said voltage-dividing resistor and said one of said pair of insulating support rods and fixed to a second one of said plurality of focus electrodes, said second one of said plurality of focus electrodes being disposed upstream of said first one of said plurality of focus electrodes in a path of said three electron beams.

2. A color cathode ray tube according to claim 1, wherein said second film contains glass of a borosilicate lead system and an oxide of at least one of Zn, Cd, Fe, Mn, Cu, Ni, Cr, Co and Zr.

3. A color cathode ray tube according to claim 1, wherein said second film is darker in color than said insulating film.

4. A color cathode ray tube according to claim 2, wherein said second film is darker in color than said insulating film.

5. A color cathode ray tube according to claim 1, wherein a thickness of said second film is greater than that of said insulating film.

6. A color cathode ray tube according to claim 2, wherein a thickness of said second film is greater than that of said insulating film.

7. A color cathode ray tube according to claim 3, wherein a thickness of said second film is greater than that of said insulating film.

8. A color cathode ray tube according to claim 4, wherein a thickness of said second film is greater than that of said insulating film.

* * * * *